United States Patent [19]

Paulsen

[11] Patent Number: 4,690,052

[45] Date of Patent: Sep. 1, 1987

[54] MEANS FOR COMPENSATING FOR VARIATIONS IN THE MATRIX HEIGHT AND OPTIONALLY THE PAPER THICKNESS ON A ROTARY PRINTING MACHINE

[76] Inventor: Gustav Paulsen, Ovre Strandgt. 107, N-4000 Stavanger, Norway

[21] Appl. No.: 749,824

[22] Filed: Jun. 28, 1985

[30] Foreign Application Priority Data

Aug. 24, 1984 [NO] Norway ..... 843379

[51] Int. Cl.[4] ..... B41F 5/00

[52] U.S. Cl. ..... 101/216; 101/248

[58] Field of Search ..... 101/216–218, 101/248, 247, 329, 174, 136, 141, 349, 375, 376, 377, 379, 152

[56] References Cited

U.S. PATENT DOCUMENTS

| | | | |
|---|---|---|---|
| 2,362,069 | 11/1944 | Huck | 101/216 |
| 3,812,780 | 5/1974 | Borelli | 101/216 |
| 4,458,590 | 7/1984 | Egnaczak et al. | 101/218 |

FOREIGN PATENT DOCUMENTS

| | | | |
|---|---|---|---|
| 536632 | 1/1957 | Canada | 101/248 |
| 53277 | 6/1982 | European Pat. Off. | 101/216 |
| 2701670 | 7/1978 | Fed. Rep. of Germany | 101/216 |
| 2802153 | 7/1979 | Fed. Rep. of Germany | 101/217 |
| 2901959 | 7/1980 | Fed. Rep. of Germany | 101/216 |
| 3076 | of 1914 | United Kingdom | 101/216 |
| 1374814 | 11/1974 | United Kingdom | 101/248 |

*Primary Examiner*—E. H. Eickholt

*Attorney, Agent, or Firm*—Schwartz, Jeffery, Schwaab, Mack, Blumenthal & Evans

[57] ABSTRACT

A rotary printing press comprising a matrix mounted on a matrix cylinder, at least one inking roller and a counterpressure cylinder. The press includes flexible members and pneumatic cylinders operative between supports for the cylinders and rollers, which are arranged to compensate for variations in thicknesses of the matrix and/or the paper.

6 Claims, 4 Drawing Figures

MEANS FOR COMPENSATING FOR VARIATIONS IN THE MATRIX HEIGHT AND OPTIONALLY THE PAPER THICKNESS ON A ROTARY PRINTING MACHINE

BACKGROUND

1. Field of the Invention

The present invention relates to a means for compensating for variations in the matrix height (thickness) and optionally the paper thickness on a rotary printing machine, particularly rotogravure printing presses.

2. Prior Art

Prior art compensating means of this type are usually based on a rigid connection between the roller or cylindrical axes, i.e., the center-to-center distance between the cooperating cylinders/rollers is fixed once the machine has been adjusted. Compensation for variations in the height or thickness of the matrix is achieved by mechanically adjusting the distance between the cylinder axes until the correct contact has been obtained with the matrix and the cylinders are then locked in this position.

In principle this adjustment could be obtained by changing the thickness of the matrix with respect to immovable cylinders, but this solution is labour-intensive and impractical.

SUMMARY

The present invention differs from the prior art in that the compensating means provides a desirable degree of flexibility for fine adjustment of the center-to-center distance between the (pairs of) rollers/cylinders, such that the compensating means adapts to the desired distance between adjacent cylinder surfaces, said distance (the nip) being primarily dependent on the thickness of the matrix and secondarily on the paper thickness.

The compensating means of the present invention is based on the use of flexible support rings/stop members which cooperate directly or indirectly with the rollers/cylinders and/or their support means. The rollers, as known per se, are mounted so as to permit mutual movement transversely of their longitudinal axes. Pneumatic cylinders may be provided for moving the rollers toward each other in order to reduce the width of the slot (nip) between adjacent roller surfaces. As the rollers are moved closer together, the elastically resilient support rings or stop members become compressed until the rollers reach a point of equilibrium at the desired center-to-center distance between the roller axes (basic setting or adjustment). Thereafter, the compensating means, being elastically resilient, is flexible around this nip width and can adjust to small variations in the matrix height and paper thickness.

Since the distance between the axes of a pair of rollers or cylinders is variable and the support rings/stop members are compressed when said center-to-center distance is reduced, being resiliently adjustable to variations following the initial or basic adjustment of the rollers, the support rings/stop members should be mounted independently of the cylinder/roller with which they have a common fixed axis. This will prevent relative movements between the surface of the roller and the flexible support rings, thus reducing wear.

BRIEF DESCRIPTION OF THE DRAWINGS

Exemplary embodiments of the compensating means of the invention are set out in the following description and are schematically illustrated in the accompanying drawings, wherein.

DETAILED DESCRIPTION OF THE INVENTION

Figure 1:
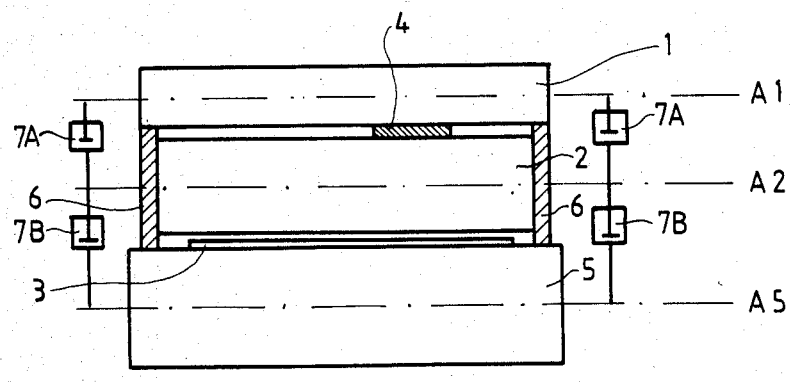
FIG. 1 shows a pair of cooperating rollers for use on a rotogravure printing press, in front view, together with a first embodiment of the compensating means of the invention.

In the drawings of the various embodiments of a means for compensating or variations in the matrix height (thickness) on a rotary press, like components are identified by the same reference number, and when the components have a different configuration or arrangement but execute the same technical function, the same reference number plus a letter of the alphabet is utilised.

The compensating means is in the accompanying drawings shown in connection with a rotogravure printing press comprising cooperating pairs of rollers/cylinders, namely one (or more) inking rollers 1 for transferring ink, chemical substances, coating compositions, lacquer, etc. to a matrix 4 affixed to a matrix cylinder 2, which in turn transfers the ink, etc. to a moving web of paper 3 which is pressed against the matrix 4 by a counterpressure cylinder 5.

The axes of rotation for inking roller 1, the matrix cylinder 2 and the counterpressure cylinder 5 are designated A1, A2 and A5 respectively.

Figure 2:
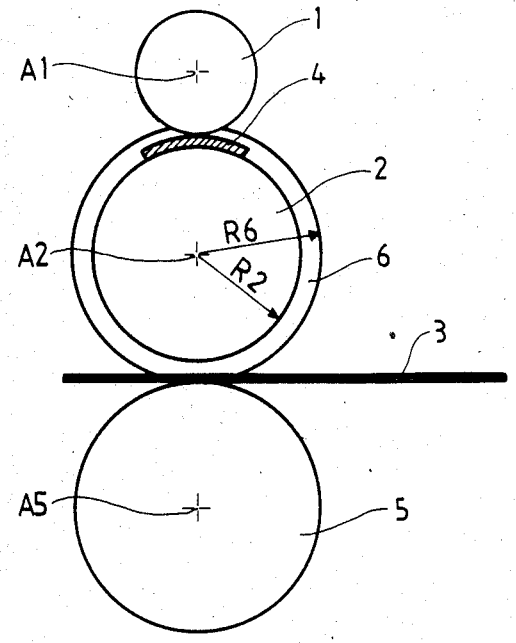
FIG. 2 shows the equipment in FIG. 1 in end view (the pneumatic cylinder which initiates the power driven movement between the pair of rollers is not visible in the drawing) and FIGS. 3 and 4 show alternative embodiments of the flexible compensating means.

In the first illustrated embodiment, FIGS. 1 and 2, a flexible support ring 6 is provided at each end of the matrix cylinder 2 which is disposed between the inking roller 1 and the counterpressure cylinder 5. The support rings 6 have a larger radius R6 than the radius R2 of the matrix cylinder 2 and thus form an elastically resilient surface of contact for the inking roller 1 and the counterpressure cylinder 5, which are adapted to be pressed toward each other, preferably with stepless adjustment, by cooperating pairs of pneumatic cylinders 7A and 7B. A roller system which can automatically adjust to variations in the thickness (height) of the matrix 4 is thereby obtained. In order to transfer ink to the matrix 4, the inking roller 1 must penetrate a distance into the flexible support rings 6, which is made to occur by increasing the pressure from the compressed air cylinders 7A, thus causing the support rings (see FIG. 2) to yield resiliently. For applying the print to the web of paper 3, the pressure from the compressed air cylinders 7B is increased, thus pressing the counterpressure cylinder 5 partially into the flexible support rings 6 until the correct contact with the paper 3 is obtained, which will compensate for variations in the paper thickness.

Figure 3:
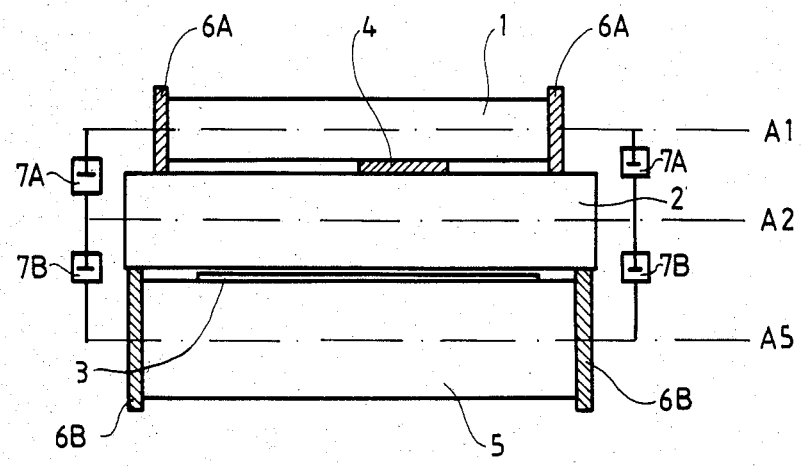

A second embodiment is shown in FIG. 3. The roller system as well as the arrangement of pneumatic cylinders 7A, 7B for moving the inking roller 1 and counterpressure cylinder 5 are identical to the first embodiment. The flexible support rings are designated 6A and 6B in FIG. 3. As in the first embodiment, the support rings have a larger radius than both the inking roller and the counterpressure cylinder 5 and their function is to establish an elastically resilient surface of contact with the roller and/or cylinder surface. Instead of support rings mounted at the ends of the intermediate matrix cylinder 2, however, in this embodiment two pairs of support rings 6A and 6B are arranged at the respective ends of both the inking roller 1 and the counterpressure cylinder 5. Thus, the support rings in this case form an elastically resilient surface of contact for the matrix cylinder 2. In addition to permitting the pressure from the compressed air cylinders 7A, 7B to be varied for obtaining different degrees of adjustment between the matrix 4 and the inking roller 1 and between the matrix 4 and the paper web 3 by means of the counterpressure cylinder 5, this arrangement also makes it possible to vary the hardness and the diameter of the support rings 6A, 6B, which with correct adjustment of the system gives this arrangement an added flexibility.

Figure 4:
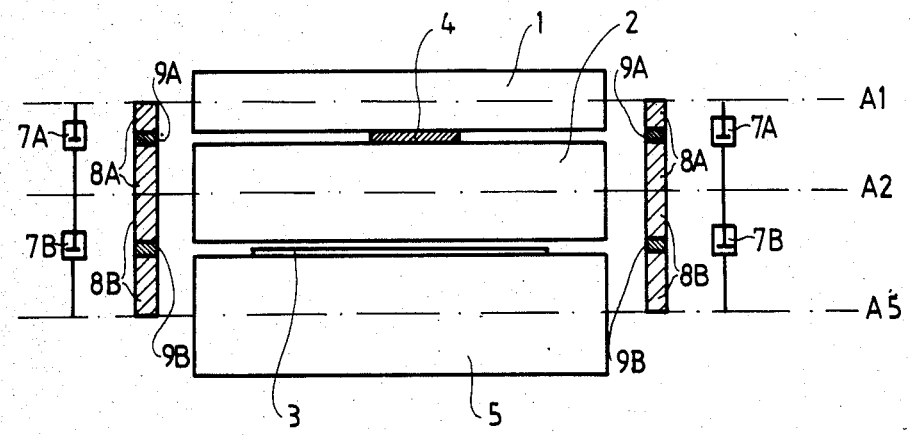

The embodiment shown in FIG. 4 also utilises the same reference numbers to designate analogous components, namely the inking roller 1, matrix cylinder 2, paper 3, matrix 4 and counterpressure cylinder 5. Similarly, 7A and 7B represent cooperating pairs of pneumatic cylinders which act upon the support means for the roller 1 and cylinder 5 for adjusting the center-to-center distance (from A1 to A5) to obtain the correct contact pressure between the roller 1 and matrix 4 and between the matrix and the paper 3. Thus far, then, the compensating means shown in FIG. 4 corresponds exactly to the two embodiments already shown and described. However, the establishment of an elastic, resilient mounting of the cooperating pairs of rollers/cylinders is obtained in a somewhat different manner in FIG. 4, which does not have flexible support rings forming a direct surface of contact with the roller or cylinder surface. Instead, the flexible support rings (6: 6A,6B) are replaced by a flexible support means for the roller 1 and cylinder 5 comprising mechanical stop members 8A, 8B for the shaft pins/bearings at the ends of the roller 1 and cylinders 2, 5, with intermediately disposed flexible plates 9A, 9B. As in FIG. 3, it is also possible in this embodiment to utilise plates 9A, 9B of varying degrees of hardness and to apply different degrees of pressure by means of the compressed air cylinders 7A, 7B between the respective axes of rotation A1, A2 and A5.

The invention is not restricted to the embodiments shown and described above, but can be modified and varied within the scope of protection defined by the appurtenant patent claims. Thus, the flexible support rings may be supported independently of the cylinder or roller with which they share a commmon axis in order to avoid relative movements at the contact surface between the support ring and the cylinder/roller.

I claim:

1. A means for compensating for variations in matrix height (thickness) and optionally variations in paper thickness on a rotary printing press, especially a rotogravure printing press which comprises cooperating pairs of rollers/cylinders including at least one inking roller (1) for transferring ink or the like to a matrix (4) detachably mounted on a matrix cylinder (2) that cooperates with the inking roller (1), the matrix (4) being adapted in turn to transfer the ink or the like to a moving web of paper (3) which passes over and is intended to be pressed against the matrix (4) by a counterpressure cylinder (5) which thus is adapted to cooperate with the matrix (2), means for supporting the rollers/cylinders, wherein the center-to-center distance between the axes of cooperating pairs of rollers/cylinders (A1-A2 and A2-A5) is adjustable for adapting to varying matrix and/or paper thicknesses, power driven means for causing a power driven relative movement between cooperating pairs of rollers/cylinders transversely to their longitudinal axes for adjusting said center-to-center distance, characterized in that the power driven means are flexible power driven means (7A, 7B), and that the supporting means for the cooperating pairs of rollers/cylinders (1-2 and 2-5) also comprise compensating means in the form of flexible spacer members (6; 6A, 6B; 9A, 9B) which upon a reduction of said center-to-center distance (A1, A2; A2-A5) are capable of being compressed with elastic deformation, such that the flexible spacer members (6; 6A, 6B; 9A, 9B) provide a counterforce against the flexible power driven means (7A, 7B), and that the reduced center-to-center distance between the cooperating pairs of rollers is defined by equilibrium between forces from the flexible means (7A, 7B) acting on respective pairs of rollers/cylinders and forces from the flexible spacer members and that the reduced center-to-center distance is flexible for adapting and accommodating variations in the matrix height and/or paper thickness.

2. A compensating means according to claim 1, characterised in that said flexible spacer members (6; 6A,6B; 9A,9B) are mounted independently of the cylinder/roller with which they share a common fixed axis.

3. A compensating means according to claim 1 characterised in that the flexible spacer members (6; 6A,6B) are in the form of elastically resilient support rings which are in direct contact with the roller or cylinder surfaces, and said rollers/cylinders upon reduction of their center-to-center distance are pressed partially into the support rings as the latter become compressed.

4. A compensating means according to claim 3, characterised by at least two flexible support rings (6) mounted at each end of the matrix roller (2) which is disposed intermediate the inking roller (1) and the counterpressure cylinder (5), wherein the matrix roller (2) has a shorter longitudinal extension than said roller (1) and cylinder (5) and also has a smaller radius (R2) than the radius (R6) of the flexible support rings (6).

5. A compensating means according to claim 3, characterised by at least four flexible support rings (6A, 6B) mounted one at each end of the inking roller (1) and counterpressure cylinder (5) respectively and cooperating with the surface of the intermediate matrix cylinder (2), wherein the inking roller (1) and the counterpressure cylinder (5) both are shorter in length than the matrix roller (2) and have a smaller radius than their associated flexible support rings.

6. A compensating means according to claim 1, characterised by flexible plate or disc-shaped members (9A, 9B) disposed between mechanical end stops (8A, 8B) which extend parallel with the end surfaces of the rollers/cylinders (1, 2, 5), which are connected to the support means for the rollers/cylinders in such manner that a reduction of the center-to-center distance between the axes (A1-A2; A2-A5) of cooperating pairs of rollers/cylinders causes a certain degree of compression of the intermediate flexible plates (9A,9B).

* * * * *